US006997151B2

(12) United States Patent
Axmacher et al.

(10) Patent No.: US 6,997,151 B2
(45) Date of Patent: Feb. 14, 2006

(54) CONTROL DEVICE FOR ADJUSTING THE ANGLE OF ROTATION OF A CAMSHAFT

(75) Inventors: Detlef Axmacher, Iserlohn (DE); Massimilliano Gasparro, Halver (DE); Dirk Neubauer, Nachrodt-Wiblingwerde (DE); Frank Pachan, Dortmund (DE); Lars Pfutzenreuter, Werdohl (DE); Markus Wilke, Nurtingen (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/054,065

(22) Filed: Feb. 9, 2005

(65) Prior Publication Data

US 2005/0211208 A1 Sep. 29, 2005

Related U.S. Application Data

(63) Continuation of application No. PCT/DE03/02607, filed on Aug. 4, 2003.

(30) Foreign Application Priority Data

Aug. 9, 2002 (DE) ..... 102 36 507

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS

| | | | | |
|---|---|---|---|---|
| 3,482,521 | A | 12/1969 | Wolf | |
| 5,311,846 | A | 5/1994 | Mueller | |
| 5,361,736 | A * | 11/1994 | Phoenix et al. | 123/90.17 |
| 6,523,512 | B1 * | 2/2003 | Axmacher et al. | 123/90.17 |
| 2002/0017257 | A1 | 2/2002 | Axmacher et al. | |

FOREIGN PATENT DOCUMENTS

| | | |
|---|---|---|
| DE | 42 10 038 | 9/1993 |
| DE | 44 02 992 | 9/1994 |
| DE | 100 38 354 | 2/2002 |
| WO | WO 01/11201 | 2/2001 |

* cited by examiner

*Primary Examiner*—Thomas Denion
*Assistant Examiner*—Zelalem Eshete
(74) *Attorney, Agent, or Firm*—Volpe and Koenig, PC

(57) ABSTRACT

The present invention relates to a control device for adjusting the angle of rotation of a camshaft in relation to the angle of rotation of a crankshaft, by means of a wobble plate mechanism situated between the camshaft and the crankshaft, in which mechanical means for limiting the adjustment of the angle of the angle of rotation are situated between the crankshaft and the camshaft.

8 Claims, 1 Drawing Sheet

CONTROL DEVICE FOR ADJUSTING THE ANGLE OF ROTATION OF A CAMSHAFT

This is a continuation of PCT/DE03/02607 filed Aug. 4, 2003.

BACKGROUND

The present invention relates to a control device for adjusting the angle of rotation of a camshaft according to the preamble of patent claim 1, as is known for example from DE 100 38 354 A1.

In the generic reference DE 100 38 354, a control device is described for adjusting the angle of rotation of a camshaft in relation to the angle of rotation of a crankshaft. In this control device, a rotating disk connected to the crankshaft and a rotating disk connected to the camshaft are interlocked with one another via a wobble plate of a wobble plate mechanism. The rotating disk of the crankshaft and the rotating disk of the camshaft have a different number of teeth, causing an offset of the angle of rotation between the two rotating disks when a drive produces a wobbling rotation of the wobble plate.

The offset between the angle of rotation of the crankshaft and the angle of rotation of the camshaft may not exceed a boundary value, because otherwise the internal combustion engine can no longer reliably operate according to the four-stroke principle. If the offset is extreme, for example in the case of a defect of the wobble plate mechanism, the pistons can impact against the opened gas exchange valves, thus destroying the cylinder head.

SUMMARY

The underlying objective of the present invention is to provide a control device for adjusting the angle of rotation of the camshaft according to the preamble of patent claim 1, in which the angle of rotation with which the camshaft can be rotated in relation to the crankshaft is limited.

According to the present invention, this objective is achieved by the feature in the characterizing part of patent claim 1, according to which mechanical means are situated between the crankshaft and the camshaft for limiting the adjustment of the angle of rotation. If the wobble plate mechanism is fashioned in such a way that the crankshaft is connected via a primary drive with a camshaft wheel that is mounted in rotatable fashion on the camshaft, and that a rotating disk is connected to the camshaft, the camshaft wheel and the rotating disk being interlocked through the wobble plate of the wobble plate mechanism, then, as a mechanical means for limiting the adjustment of the angle of rotation, an opening is formed on the rotating disk in which a stop formed on the camshaft wheel engages.

The maximum angle of rotation by which the camshaft and the crankshaft can be offset relative to one another is determined by the width of the opening and by the width of the stop.

In a further development of the present invention, it is provided that a sensor device for determining the position of the stop and for determining the position of the opening is situated inside the wobble plate mechanism.

This sensor device is advantageously fashioned as a Hall sensor that senses the side edges of the opening of the rotating disk and the outer edges of the stop of the camshaft wheel.

Such a sensor device for determining the position of the opening and of the stop can additionally be used to determine the position of the camshaft and of the crankshaft.

Here, the position of the camshaft can for example be determined by determining the midpoint between the outer edges of the opening of the rotating disk. Correspondingly, the position of the crankshaft is determined by determining the midpoint between the two edges of the stop of the camshaft wheel.

BRIEF DESCRIPTION OF THE DRAWINGS

In the following, the control device according to the present invention for adjusting the angle of rotation of a camshaft is described and explained on the basis of an exemplary embodiment in connection with three Figures.

DETAILED DESCRIPTION OF THE PREFERRED EMBODIMENTS

Figure 1:
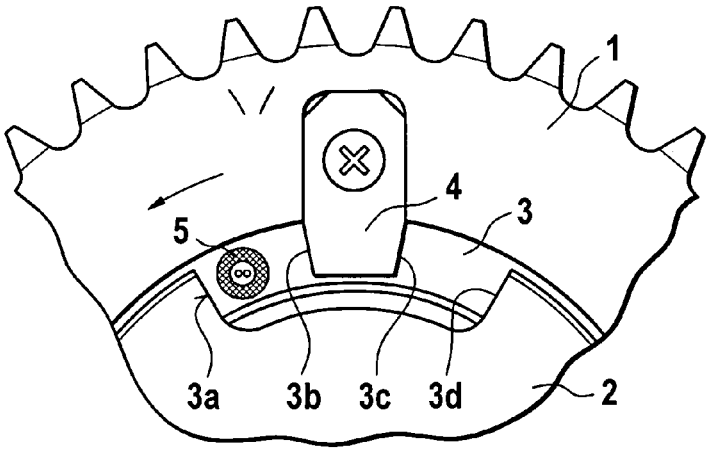
FIG. 1 shows a representation of the rotating disk of the crankshaft, having an opening, and the stop formed on the camshaft wheel.

FIG. 1 shows a part of camshaft wheel 1, connected to the crankshaft via a timing chain, and a part of the camshaft, which bears rotating disk 2. Rotating disk 2 can either be manufactured in one piece with the camshaft, or can be connected to the camshaft for example by screws. Camshaft wheel 1 and rotating disk 2 are non-positively connected to one another via the wobble plate, which is not visible in this representation.

In order to avoid too-large of an offset between the crankshaft and the camshaft, an opening 3 is formed on rotating disk 2 of the camshaft, into which a stop 4 fashioned on camshaft wheel 1 protrudes. Opening 3 and stop 4 are dimensioned in such a way that the non-positive fit between the crankshaft and the camshaft can take place via stop 4.

In order to influence the opening times of the gas exchange valves, the opening on the rotating disk can take up an angular segment of 40 to 70 degrees.

The respective positions of opening 3 and stop 4 during the operation of the internal combustion engine are sensed by a sensor device having a Hall sensor 5 as a sensor. During rotation of the camshaft, Hall sensor 5 senses side edges 3*a* and 3*d* of opening 3, as well as outer edges 3*b* and 3*c* of stop 4.

Figure 2:
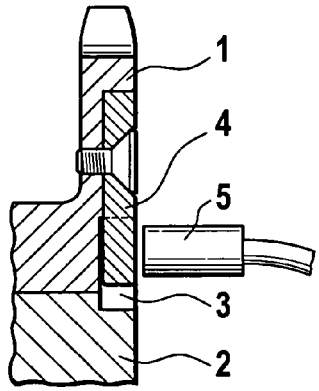
FIG. 2 shows a section through the camshaft wheel and the camshaft.

FIG. 2 shows, in a sectional image, the position of Hall sensor 5 in relation to stop 4 of camshaft wheel 1 and in relation to opening 3 of rotating disk 2 of the camshaft. Stop 4 can be machined and screwed into camshaft wheel 1, or can be manufactured in one piece with camshaft wheel 1 by milling.

Figure 3A:
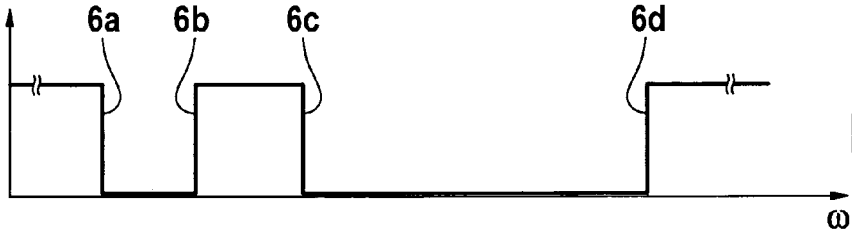
FIGS. 3*a*–3*c* show three diagrams with signals sensed by a Hall sensor through the edges of the opening and the edges of the stop.
Figure 3B:
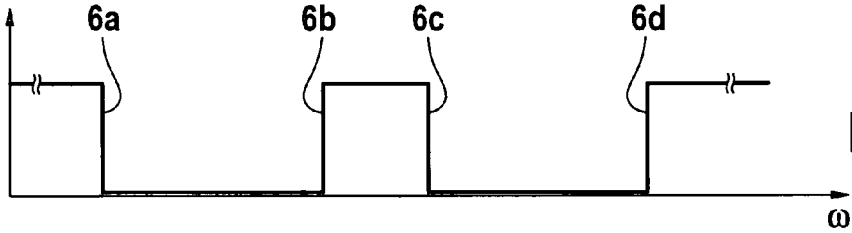
Figure 3C:
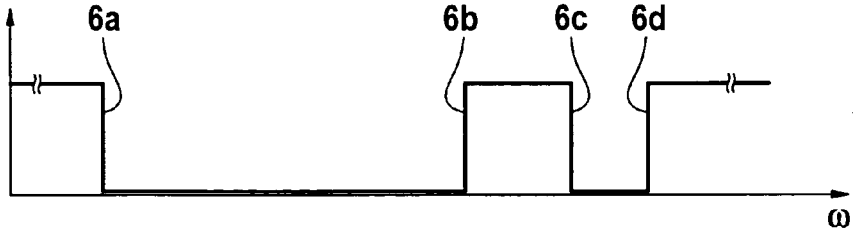

In FIGS. 3*a* to 3*c*, the signals sensed by the Hall sensor are plotted against angle of rotation ω. Here, opening 3 appears as a low signal level between edges 6*a* and 6*d*. Apart from the edges 6*a* and 6*d*, Hall sensor 5 senses a high signal level caused by the walls of rotating disk 2. Stop 4 appears within edges 6*a* and 6*d* of opening 3 as a high signal level of small width, having edges 6*b* and 6*c*. Thus, by evaluating this signal curve, the position of stop 4 within opening 3 of rotating disk 2 can be determined, and from this the current offset between the crankshaft and the camshaft can be determined.

FIG. 3*a* shows the position, characterized by edges 6*b* and 6*c*, of stop 4 of camshaft wheel 1, which lags the curve of the rotational speed of the camshaft. Given an offset of this sort between the crank shaft and the camshaft, during the working cycle the gas exchange valves open earlier than in a normal internal combustion engine having a rigid connection between the crankshaft and the camshaft.

FIG. 3*b* shows the position, characterized by edges 6*b* and 6*c*, of stop 4 of camshaft wheel 1, which follows the curve of the rotational speed of the camshaft. Here, during the working cycle the gas exchange valves open as in a normal internal combustion engine.

FIG. 3*c* shows the position, characterized by edges 6*b* and 6*c*, of stock 4 of camshaft wheel 1, which leads the curve of the rotational speed of the camshaft. Given an offset of this sort between the crankshaft and the camshaft, during the working cycle the gas exchange valves open later than in a normal internal combustion engine.

In addition, the position of the crankshaft and of the camshaft can be determined by evaluating the signal curve, so that the standard devices in an internal combustion engine for determining the position of the crankshaft and the camshaft can be omitted. Advantageously, the midpoints of edges 6*a* and 6*d* of opening 3 of rotating disk 2, as well as edges 6*b* and 6*c* of stop 4, are determined. In addition, additional openings can be made in rotating disk 2, through which the position of the rotating disk can be determined with a high degree of resolution.

Through the opening 3 of rotating disk 2 of the camshaft wheel and the stop 4 formed on the camshaft wheel 1, damages to the internal combustion engine caused by a too-large offset in the angle of rotation between the crankshaft and the camshaft can be avoided.

What is claimed is:

1. Control device for adjusting the angle of rotation of a camshaft in relation to the angle of rotation of a crankshaft using a wobble plate mechanism situated between the camshaft and the crankshaft, comprising mechanical means for limiting adjustment of the angle of rotation situated between the crankshaft and the camshaft.

2. Control device according to claim 1, wherein the crankshaft is connected to the camshaft via a primary drive, and a camshaft wheel (1) located on the camshaft is connected to the primary drive and is mounted so as to be capable of rotation, a rotating disk (2) is connected to the camshaft, and the camshaft wheel (1) and the rotating disk (2) are connected through a wobble plate of the wobble plate mechanism.

3. Control device according to claim 2, wherein an opening (3) is formed on the rotating disk (2), and a stop (4) is formed on the camshaft wheel (1) that engages in the opening (3) of the rotating disk (2).

4. Control device according to claim 3, wherein a maximum angle of rotation by which the camshaft and the crankshaft can be adjusted in relation to one another is determined by a width of the opening (3) and by a width of the stop (4).

5. Control device according to claim 3, wherein a sensor device for determining a position of the stop (4) and for determining a position of the opening (3) is situated inside the wobble plate mechanism.

6. Control device according to claim 5, wherein the sensor device is formed as a Hall sensor (5) that senses side edges (3*a*, 3*d*) of the opening (3) of the rotating disk (2) and senses outer edges (3*b*, 3*c*) of the stop (4) of the camshaft wheel (1).

7. Method for operating the control device according to claim 6, wherein the sensor device for determining the position of the opening (3) and of the stop (4) determines the position of the camshaft and of the crankshaft.

8. Method according to claim 7, wherein the position of the camshaft is determined by determining a midpoint between the side edges (3*b*, 3*c*) of the opening (3) of the rotating disk (2), and the position of the crankshaft is determined by determining a midpoint between the outer edges (3*b*, 3*c*) of the stop (4) of the camshaft wheel (1).

* * * * *